US006645910B1

(12) United States Patent
Sato et al.

(10) Patent No.: US 6,645,910 B1
(45) Date of Patent: Nov. 11, 2003

(54) THERMALLY SENSITIVE RECORDING MEDIUM

(75) Inventors: Reiko Sato, Shinjuku-ku (JP); Kaoru Hamada, Shinjuku-ku (JP); Yoshihide Kimura, Shinjuku-ku (JP); Takaichi Yamamoto, Ono (JP); Hiroyuki Kawabata, Ono (JP); Seiji Sugimori, Ono (JP)

(73) Assignees: Nippon Paper Industries Co. Ltd., Tokyo (JP); Ipposha Oil Industries Co. Ltd., Hyogo-Ken (JP)

( * ) Notice: Subject to any disclaimer, the term of this patent is extended or adjusted under 35 U.S.C. 154(b) by 209 days.

(21) Appl. No.: 09/588,311

(22) Filed: Jun. 6, 2000

(30) Foreign Application Priority Data

Jun. 9, 1999 (JP) ..... 11-163086

(51) Int. Cl.[7] ..... B41M 5/30

(52) U.S. Cl. ..... 503/209; 503/214

(58) Field of Search ..... 503/209, 214, 503/200

(56) References Cited

PUBLICATIONS

Japanese Laid Open No. 06073368, Publication date Mar. 15, 1994 (Abstract).
Japanese Laid Open No. 09071046, Publication date Mar. 18, 1997 (Abstract).
Japanese Laid Open No. 07137435, Publication date May 30, 1995 (Abstract).
Japanese Laid Open No. 2000–1052, Publication date Jan. 7, 2000 (Abstract).
Japanese Laid Open No. 2000–6519, Publication date Jan. 11, 2000 (Abstract).

*Primary Examiner*—Bruce H. Hess
(74) *Attorney, Agent, or Firm*—Sherman & Shalloway

(57) ABSTRACT

The present invention provides a thermally sensitive recording medium that possesses a thermally sensitive color developing layer containing colorless or pale colored basic leuco dye and an organic color developer as main components on a substrate, wherein said thermally sensitive recording medium contains at least one kind of an ultraviolet ray absorbent of aqueous emulsion type polymer composed of an emulsion copolymerized compound of (a) ultraviolet ray absorbing monomer, (b) vinyl compound monomer that can copolymerize with said monomer, (c) hydrophilic monomer and (d) reactive emulsifier.

8 Claims, No Drawings

THERMALLY SENSITIVE RECORDING MEDIUM

BACKGROUND OF THE INVENTION

1. Field of the Invention

The present invention relates to a thermally sensitive recording medium that has an excellent light resistance, and excels in appearance of unrecorded portion and color developing ability, further, prevents adherence of depositions and occurrence of sticking.

2. Description of the Prior Art

In general, a thermally sensitive recording medium is obtained by following procedure. Namely, a colorless or pale colored basic leuco dye and an organic color developer such as phenolic compound are respectively ground to fine particles and mixed together, a binder, a filler, a sensitizer, a lubricant and other additives are added, and a coating is obtained. The obtained coating is coated on a substrate such as paper, synthetic paper, film or plastic, thus a thermally sensitive recording medium is obtained. The thermally sensitive recording medium develops color by an instantaneous chemical reaction by heating with a thermal pen, a thermal head, a hot stamp or a laser ray, and a recorded image can be obtained. These thermally sensitive recording media are widely used in a field of a recorder of measuring equipment, a terminal printer of computer, a facsimile, a bar cord labeling machine and an automatic ticket vending machine.

Recently, as the applications of a thermally sensitive recording medium, uses for various kinds of caption label, indication medium such as poster and ticket are becoming more popular. However, since the stabilities to light and to heat of these kinds of thermally sensitive recording media are low, the occurrences of following problems are pointed out. That is, when said thermally sensitive recording medium is exposed to the room light or to the sun light, or left in high humid condition for long term, the background color of said medium changes to yellowish color and the appearance is spoiled, or the stability of recorded image is deteriorated, therefore, the commodity image of the thermally sensitive recording medium is remarkably damaged.

For the purpose to improve the light resistance of a thermally sensitive recording medium, a method to contain an inorganic filler that has ultraviolet ray screening effect in a thermally sensitive recording layer or a protecting layer which covers said thermally sensitive recording layer is described in Japanese Patent Laid Open Publication 62-18626 or in Japanese Patent Laid Open Publication 6-64324. However, in a case of inorganic filler that has ultraviolet ray screening effect such as zinc oxide, titanium dioxide or cerium oxide, although the ultraviolet ray screening effect of these compounds is high, the transmittance of visible radiation is low. Therefore, the color developing part is concealed and the printed image density becomes low, and if the containing amount of these compounds is reduced to prevent the occurrence of mentioned problems, the screening effect for ultraviolet rays is deteriorated and becomes not practical. Further, in a case of cerium oxide, since cerium oxide itself has light yellowish color, it is not suited as the material for a thermally sensitive recording medium.

Meanwhile, for the purpose to improve the light resistance, the method to contain fine ground particles of an ultraviolet ray absorbent in a thermally sensitive recording layer or a protecting layer which covers said thermally sensitive recording layer is disclosed (Japanese Patent Laid Open Publication 50-104650, 55-55891, 55-93492 and 58-87093). However, for the purpose to obtain a sufficient light resistance by containing fine ground particle of an ultraviolet absorbent in a thermally sensitive recording layer, it is necessary to add large amount of ultraviolet ray absorbent, because the absorbing effect and screening effect for ultraviolet rays are poor. Therefore, when these kinds of thermally sensitive recording media are kept in high temperature condition, the new problems such as background fogging or deterioration of the recorded image are caused, and the properties necessary for the thermally sensitive recording medium are damaged.

Further, when fine ground particles of ultraviolet ray absorbent are contained in a protecting layer, and if the ultraviolet ray absorbents are conventional type, these agents have low melting points and can be easily molten by the heat of a thermal head, and cause the problem of fine adherence of depositions or occurrence of sticking that stains the thermal head by long time printing. Furthermore, the ultraviolet ray absorbent is extracted from the protecting layer by the effect of plasticizer or oil, and consequently, the preserving ability of the recorded Image is deteriorated. And, in a case when the aqueous ultraviolet ray absorbent is used, as described in Japanese Patent Laid Open Publication 7-17131, since ions such as sodium salt are formed at the dissolving process of aqueous ultraviolet ray absorbent, the defect that the thermal head is damaged electric chemically is pointed out.

Further, the method to obtain a thermally sensitive recording medium that has good preserving stability and light resistance by containing microcapsules of ultraviolet ray absorbent in a protective layer is disclosed in Japanese Patent Laid Open Publication 5-155134. However, in a case of this method, the preparation of microcapsule in which fine particles of ultraviolet ray absorbent are immobilized is necessary, and to improve the absorbing efficiency of ultraviolet rays, it is necessary to make the size of microcapsule smaller. However, the size of microcapsule is restricted by the preparation method and the size of microcapsule has the smallest limit. Therefore, to obtain a sufficient light resistance, the necessary amount of the microcapsules that contain ultraviolet ray absorbent to add is increased, and the cost for the manufacturing of the thermally sensitive recording medium rises. Further, since the microcapsule in which ultraviolet ray absorbent is immobilized must be stabilized to heat and to pressure, the wall thickness of microcapsule must be thicker, and it is one of the ground of cost rising.

Recently, a thermally sensitive recording medium, which uses an ultraviolet rays absorbent prepared by polymerization of benzotriazole molecule or benzophenone molecule which has an ultraviolet ray absorbing ability, is proposed in Japanese Patent Laid Open Publication 7-314894, Japanese Patent Laid Open Publication 9-221487, Japanese Patent Laid Open Publication 9-268183, Japanese Patent Laid Open Publication 9-314496, Japanese Patent Laid Open Publication 10-71770 and Japanese Patent Laid Open Publication 10-36371. Still more, the thermally sensitive recording medium containing an ultraviolet ray absorbent of an emulsified copolymer composed of an ultraviolet ray absorbing monomer, a vinyl compound monomer which can copolymerise with said monomer and a bridgeable monomer in a thermally sensitive recording layer is described in Japanese Patent Laid Open Publication 6-73368. However, when the thermally sensitive recording media in which the compounds disclosed in these publications for patent are used, various problems mentioned below are caused, and the ultraviolet ray absorbent which has well balanced quality has not yet been obtained. Namely, problems of conventional ultraviolet ray absorbents for example; the appearance of unrecorded portion of thermally sensitive recording media are deteriorated because the color of materials itself is not so good; when used in a thermally sensitive layer, the recorded image density is deteriorated because it is necessary to add large amount of them to obtain a sufficient effect; and when used in a protective layer, the barrier ability reduces because these compounds are easily dissolved in plasticizer or oil; further the adherence of depositions or occurrence of sticking caused by the weak heat resistance, are pointed out.

As mentioned above, the method to provide a light resistance to a thermally sensitive recording medium by an ultraviolet absorbent has been carried into effect for long time, however, a sufficient method has not been developed yet.

BRIEF SUMMARY OF THE INVENTION

The object of the present invention is to provide a thermally sensitive recording medium that has good appearance of unrecorded portion and color developing ability and further that the defects such as adherence of deposition or occurrence of sticking is prevented.

The inventors of the present invention have conduced an intensive study and developed the thermally sensitive recording medium of this invention. That is, the invention of claim 1 is a thermally sensitive recording medium that possesses a thermally sensitive color developing layer containing colorless or pale colored basic leuco dye and an organic color developer as main components on a substrate, wherein said thermally sensitive recording medium contains at least one kind of aqueous emulsion type polymer ultraviolet ray absorbent composed of an emulsion copolymerized compound of (a) ultraviolet ray absorbing monomer, (b) vinyl compound monomer that can copolymerize with said monomer, (c) hydrophilic monomer and (d) reactive emulsifier.

And, the invention of claim 2 is the thermally sensitive recording medium of claim 1, wherein the glass transition temperature Tg of said emulsion copolymerized compound is not less than 50° C.

The invention of claim 3 is the thermally sensitive recording medium of claim 1 or claim 2, wherein said ultraviolet ray absorbing monomer which composes the aqueous emulsion type polymer ultraviolet ray absorbent is a compound represented by general formula I and/or general formula II, (I)

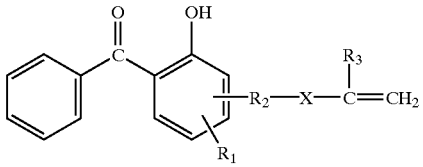

wherein, $R_1$ represents hydrogen atom, alkyl group or alkoxy group of carbon number 1–6, $R_2$ represents alkylene group or oxyalkylene group of carbon number 1–10, or not exists (in this case X combines with benzene ring directly), X represents ester bond, amide bond, ether bond or urethane bond and $R_3$ represents hydrogen atom or lower alkyl group, (II)

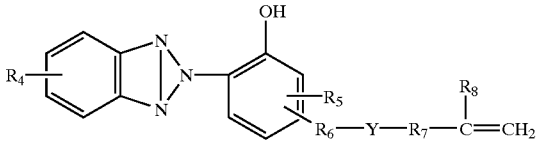

wherein, $R_4$ represents hydrogen, halogen or methyl group, $R_5$ represents hydrogen or hydrocarbon group of carbon number 1–6, $R_6$ represents alkylene group of carbon number 1–10 or oxyalkylene group or not exists (in this case Y combines with benzene ring directly), Y represents ester bond, amide bond, ether bond or urethane bond, $R_7$ represents alkylene group of carbon number 1–8, aminoalkylene group, alkyl group possessing hydroxide group at side chain or not exists (in this case Y combines with C directly), and $R_8$ represents hydrogen or lower alkyl group.

The invention of claim 4 is characterizing, said reactive emulsifier that composes the aqueous emulsion type polymer ultraviolet ray absorbent is a polymerizative vinyl compound.

DETAILED DESCRIPTION OF THE INVENTION

As the (a) ultraviolet ray absorbing monomer, which composes the aqueous emulsion type polymer ultraviolet ray absorbent, to be contained in the thermally sensitive recording medium of this invention, any kind of monomer having ultraviolet ray absorbing ability can be used. However, desirably (a) is a polymerizative vinyl compound composed of a chemically bonded product of 2-hydroxybenzopehnone group in which an alkyl group or an alkoxy group of carbon number 1–6 can be substituted or 2-hydroxybenzotriazole group in which a hydrocarbon group of carbon number 1–6 can be substituted. As the concrete example of said polymerizative vinyl compound, compounds indicated by (1) or (2) can be mentioned, however not intended to be limited to these compounds, further these kinds of ultraviolet absorbing monomers can be used together with.

(1) 2-hydroxybenzophenone derivatives represented by general formula (I).

(I)

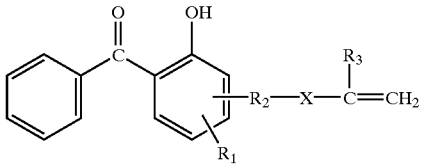

wherein, $R_1$ represents hydrogen atom, alkyl group or alkoxy group of carbon number 1–6, $R_2$ represents alkylene group or oxyalkylene group of carbon number 1–10, or not exists (in this case, X combines with benzene ring directly), X represents ester bond, amide bond, ether bond or urethane bond and $R_3$ represents hydrogen atom or lower alkyl group.

The monomer represented by general formula (I) can be obtained, for example, by reacting an ultraviolet ray absorbing compound having a functional group such as BP—$R_2$—OH (BP: 2-hydroxybenzophenone structure) with a polymerizative vinyl compound having a functional group such as $CH_2$=$CR_3$—COOH, then introducing an ultraviolet ray absorbing compound residue into polymerizative vinyl compound by means of ester bond X (—COO—).

As the concrete examples of monomer compound represented by said general formula(I), 2-hydroxy-4-acryloyloxybenzophenone, 2-hydroxy-4-methacryloyloxybenzophenone, 2-hydroxy-4-(2-acroyloxy)ethoxybenzophenone, 2-hydroxy-4-(2-methacryloyloxy)ethoxybenzophenone, 2-hydroxy-4-(2-methyl-2-acroyloxy) ethoxybenzophenone or others can be mentioned (2) 2-hydroxybenzotriazole derivatives represented by general formula (II), (II)

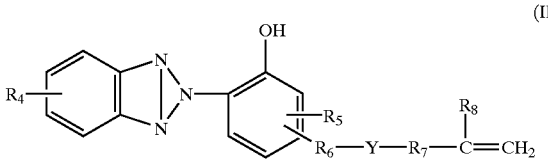

wherein $R_4$ represents hydrogen, halogen or methyl group, $R_5$ represents hydrogen or hydrocarbon group of carbon number 1–6, $R_6$ represents alkylene group of carbon number 1–10 or oxyalkylene group or not exists (in this case, Y combines with benzene ring directly), Y represents ester bond, amide bond, ether bond or urethane bond, $R_7$ represents alkylene group of carbon number 1–8, aminoalkylene group, alkyl group possessing hydroxide group at side chain or not exists (in this case, Y combines with C directly) and $R_8$ represents hydrogen or lower alkyl group.

As the concrete examples of monomer compound represented by general formula (II), 2-[2'-hydroxy-5'-(methacryloyloxy)phenyl]benzotriazole, 2-[2'-hydroxy-5'(acryloyloxy) phenyl]benzotriazole, 2-[2'-hydroxy-3'-t-butyl-5'-(methacryloyloxy)phenyl] benzotriazole, 2-[2'-hydroxy-3'-methyl-5'-(acryloyloxy)phenyl] benzotriazole, 2-[2'-hydroxy-5'-(methacryloyloxypropyl)phenyl]-5-chlorobenzotriazole, 2-[2'-hydroxy-5'-(methacryloyloxyethyl)phenyl] benzotriazole, 2-[2'-hydroxy-5'-(acryloyloxyethyl)phenyl]benzotriazole, 2-[2'-hydroxy-3'-t-butyl-5'-(methacryloyloxyethyl) phenyl]benzotriazole, 2-[2'-hydroxy-3'-methyl-5'-(acryloyloxyethyl)phenyl] benzotriazole, 2-[2'-hydroxy-5'-(methacryloyloxypropyl)phenyl]-5-chlorobenzotriazole, 2-[2'-hydroxy-5'-(acryloyloxybutyl)phenyl]-5-methylbenzotriazole,

[2-hydroxy-3-t-butyl-5-(acryloyloxyethoxycarbonylethyl)phenyl] benzotriazole or others can be mentioned.

As the other vinyl compound monomer that can copolymerize with said ultraviolet ray absorbing monomer (b) (hereinafter shortened to copolymerization monomer), acrylonitrile, acrylic acid alkyl ester, metacrylic acid alkyl ester, alkyl vinyl ether, alkyl vinyl ester or styrene can be mentioned, and although the carbon number of these compounds are not restricted, desirable carbon number is 1–18. As the concrete examples of these compounds following compounds can be mentioned.

(1) acrylic acid alkyl ester, methacrylic acid alkyl ester.

methylacrylate, ethylacrylate, butylacrylate, 2-ethylhexylacryiate, octylacrylate, laurylacrylate, stearylacrylate, methylmethacrylate, butylmethacrylate, t-butylmethacrylate, 2-ethylhexylmethacrylate or others.

(2) alkyl vinylether.

methylvinylether, ethylvinylether, propylvinylether, stearylvinylether or others.

(3) alkylvinylester vinylacetate, ethylvinyl, butylvinyl, 2-ethylhexylvinyl or others.

Copolymerization ratio of copolymerization monomer is 5–69% by weight to total weight of monomer.

In the present invention, by together use of a hydrophilic monomer (c), resistance to solvent and solubility with hydrophilic resin is further improved and a durable ultraviolet ray absorbing polymer film can be formed.

As a hydrophilic monomer, although any kind of monomer which has a hydrophilic reactive functional group can be used, desirably a hydroxy group containing monomer or a carboxylic acid containing monomer can be mentioned. As the concrete examples, following compounds can be mentioned.

(1) Hydroxy group containing monomer.

2-hydroxyethylmethacrylate, 2-hydroxyethylacrylate, hydroxypropyl methacrylate or others.

(2) Carboxylic acid containing monomer.

acrylic acid, methacrylic acid or others.

The desirable copolymerization ratio of a hydrophilic monomer is 1–20% by weight to total monomer weight. When the ratio exceeds 20 wt %, polymerization becomes difficult because of the problem of copolymerization with an ultraviolet ray absorbing monomer.

The aqueous emulsion type polymer ultraviolet ray absorbent used in this invention can be obtained by mixing each monomer with emulsifier in aqueous solvent and by emulsion polymerization using a aqueous polymerization initiator.

The emulsion copolymer is desirable to have a relatively high glass transition temperature (Tg), and when Tg is not less than 50° C., good heat resistance of film (durability to sticking) can be obtained. Desirable Tg is not less than 70° C. and more desirable Tg is not less than 80° C. In the present invention, by adjusting the monomer ratio for emulsion copolymerization, the aqueous emulsion type polymer ultraviolet ray absorbent whose Tg is not less than 50° C. can be easily obtained.

As the reactive emulsifier, any kind of conventional reactive emulsifier used in the usual emulsion polymerization that the radical polymerization is possible can be used, however, a polymerizative vinyl compound is desirably used. These reactive emulsifier can be used alone or can be used together with. Since these emulsifiers are introduced into the copolymer obtained at the emulsion polymerization, the bad influences to the water resistance and to the transparency of film, which usually occur in non-reactive emulsifier after the formation of film, are effectively prevented. As the concrete examples of the reactive emulsifier, Latemul S-180, S-180A, S-120A (products of Kao Co., Ltd.), Aqualon HS-10, HS-20, RN-20 series (Daiichi Kogyo Seiyaku Co., Ltd.), Eleminor JS-2 (Sanyo Kasei Industries Co., Ltd.) and Adekaria soap NE-30 (Asahi Denka Industries Co., Ltd.) can be mentioned. The Aqualon series comprises a RN and HS series, wherein RN are nonion type surface active detergents and HS are anion type surface active detergents having the general chemical structure R-phenyl $(CH{=}CHCH_3)O(CH_2CH_2O)_mSO_3NH_4$. The Latemul series compounds contain the general chemical structure $MO_3SCH—(H_2C—COOR)—COOCH_2CO(OH)$ $CH_2OCH_2CH{=}CH_2$, wherein R is $C_{12}$ and $C_{18}F_1$, and M is Na or $NH_4$. From the view point of color developing ability of the thermally sensitive recording medium, anion type reactive emulsifier is desirably used. The desirable amount of the reactive emulsifier to be used is 0.5–5 weight parts to 100 weight parts of total monomer amount. If the amount of use is over than 5 weight parts, the effect to a basic leuco dye is too strong and is a ground to interfere the color developing, and the water resistance of the film is weakened.

Generally, the conventional emulsifier, which is used for the emulsification, surrounds and contacts the whole surface of emulsified material. Meanwhile, the reactive emulsifier used in this invention reacts with the emulsified material and is introduced into it, and not remains the original form of emulsifier. Therefore, the aqueous emulsion type polymer ultraviolet absorbent of this invention becomes soap free, and has a strong point that does not influence badly on the color developing material.

As the polymerization initiator, peroxide such as persulfate, percarbonate or perborate, or azo type aqueous polymerization initiator such as 2,2'-azobis[2-(2-imidazoline-2-yl)propane] hydrochloride, 2,2'-azobis(2-methylpropionamidine)hydrochloride, 2,2'-azobis[N-(2-hydroxyethyl)-2-methylpropionamidine]hydrochloride, 2,2'-azobis[2-(5-hydroxy-3,4,5,6-tetrahydropyrimidine-2-yl)propane]hydro-chloride and others can be used. Desirable amount of aqueous polymerization initiator is 0.05–1 wt % to total weight of monomer.

The shape of emulsion copolymer that composes the aqueous emulsion type polymer ultraviolet ray absorbent used in this invention is an inner bridged type polymer particle, and the desirable average particle size is 500 nm–80 nm, further, more desirable average particle size is over than 100 nm and furthermore desirable average particle size is not less than 180 nm. And the upper limit of particle size is desirably smaller than 400 nm and more desirably is not exceed 300 nm. The aqueous emulsion type polymer ultraviolet ray absorbent of this invention can be obtained by the emulsion polymerization using above mentioned components and the examples for actual preparation method are mentioned below.

Preparation Example 1

301 g of monomer mixture composed of 1 g of Aqualon HS-20 (product of Daiichi Kogyo Seiyaku Co., ltd.), 50 g of 2-hydroxy-4-(2-methacryloxy)ethoxy benzophenone, 10 g of acrylic acid 2-hydroxyethyl, 40 g of methylmethacrylate and 200 g of deionized water is prepared, and 100 g of said mixture is poured into a glass reactor to which a thermometer, a stirrer, a reflux condenser, a nitrogen gas induction tube and a dropping funnel are attached and emulsified for 30 minutes at the temperature of 70° C. Then, as the aqueous polymerization initiator, aqueous solution that is prepared by adding 0.5 g of 2,2'-azobis[2-(2-imidazoline-2-yl)propane]hydrochloride to 33 g of deionized water is added to said glass reactor, then immediately after, remaining amount of the monomer mixture is dropped into the glass reactor constantly during 90 minutes, and the polymerization is carried out at the temperature of 70° C. After all amount of monomer mixture is dropped, the content in the glass reactor is ripened for 90 minutes at the temperature of 70° C., thus the aqueous emulsion type polymer ultraviolet ray absorbent of Preparation Example 1 is obtained.

Further, the aqueous emulsion type polymer ultraviolet ray absorbents of Preparation Examples 2–8 are obtained by changing an ultraviolet ray absorbing monomer, a hydrophilic monomer, a copolymerization monomer, a reactive emulsifier and aqueous polymerization initiator as mentioned in Table 1. The numerical number in a parenthesis appears in the table indicates the amount to be used of each components. The 50 g of constant amount of ultraviolet ray absorbing monomer is used in each Preparation Example.

TABLE 1

| U.V. ray absorbant | U.V. absorbing monomer | hydrohilic monomoer | copoly-merization monomer | reactive emulsifier | polymerization initiator | Tg (° C.) | particle size |
|---|---|---|---|---|---|---|---|
| Preparation Example 1 | 2-hydroxy-4-(2-metha cryloxy)ethoxybenzo phenone (50) | acrylic acid 2-hydroxyethyl (10) | methyl methacrylate (40) | Aqualon HS-20 (Daiichi Kogyo Seiyaku) (1) | 2,2'-azobis[2-(2-imidazoline-2-yl)propane]hydrochloride (0.5) | 85 | 200 nm |
| Preparation Example 2 | 2-hydroxy-4-metha cryloxy-benzophenone (50) | 2-ethylhexyl methacrylate (3) | methyl methacrylate (47) | Aqualon HS-20 (Daiichi Kogyo Seiyaku) (1) | 2,2'-azobis[2-(2-imidazoline-2-yl)propane]hydrochloride (0.5) | 84 | 200 nm |
| Preparation Example 3 | 2-[2'hydroxy-5'-(metha cryloyloxy)phenyl] benzotriazole (50) | 2-hydroxyethyl acrylate (2) | methyl acrylate (48) | Aqualon HS-10 (Daiichi Kogyo Seiyaku) (2) | 2,2'-azobis[2-(2-imidazoline-2-yl)propane]hydrochloride (1) | 85 | 100 nm |
| Preparation Example 4 | 2-hydroxy-4-(acryloyl oxybenzophenon (50) | methacrylic acid (1) | ethyl methacrylate (49) | Latemul S-120A (Kao Co., Ltd.) (1) | 2,2'-azobis[N-(2-hydroxy ethyl)-2-methylpropion amidine]hydrochloride (1) | 70 | 300 nm |
| Preparation Example 5 | 2-[2hydroxy-5-(metha cryloyloxy)phenyl]-5-chlorobenzotriazole (50) | acrylic acid (1) | butyl methacrylate (49) | Latemul S-180 (Kao Co., Ltd.) (4) | 2,2'-azobis[2-(5-hydroxy-3,4,5,6-tetrahydro pyrimidine-2-yl)propane] hydrochloride (0.5) | 50 | 80 nm |
| Preparation Example 6 | 2-[2'hydroxy-5'-(metha cryloyloxy)phenyl] benzotriazole (50) | acrylic acid(1)/ 2-ethylhexyl methacrylate (10) | methyl methacrylate (39) | Aqualon HS-20 (Daiichi Kogyo Seiyaku) (1) | 2,2'-azobis[2-(2-imidazoline-2-yl)propane]hydrochloride (0.5) | 75 | 200 nm |
| Preparation Example 7 | 2-[2'hydroxy-5-(metha cryloyloxy)phenyl]-5-chlorobenzotriazole | acrylic acid (1) | butylmethacryl ate(29)/methyl methacrylate | Aqualon HS-20 (Daiichl Kogyo Seiyaku) (1) | 2,2'-azobis[2-(5-hydroxy-3,4,5,6-tetrahydro pyrimidine-2-yl)propane] | 60 | 80 nm |

TABLE 1-continued

| U.V. ray absorbant | U.V. absorbing monomer | hydrohilic monomoer | copoly-merization monomer | reactive emulsifier | polymerization initiator | Tg (° C.) | particle size |
|---|---|---|---|---|---|---|---|
| | (25)/2-hydroxy-4-metha cryloxy-benzophenone (25) | | (20) | | hydrochloride (0.5) | | |
| Preparation Example 8 | 2-(2'hydroxy-5'-(metha cryloyloxyethylphenyl)-2H-benzotriazole (50) | 2-ethylhexyl methacrylate (10)/methacrylic acid (1) | methyl methacrylate (39) | Aqualon HS-20 (Daiichi Kogyo Seiyaku) (1) | 2,2'-azobis[2-(2-imidazoline-2-yl)propane]hydrochloride (0.5) | 80 | 200 nm |

Numerical number in parenthesis: used weight (g)

In the present invention, by containing at least one kind of aqueous emulsion type polymer ultraviolet ray absorbent in at least one layer of a thermally sensitive recording medium, which is specified below, has, properties of the thermally sensitive recording medium such as light resistance, appearance of unrecorded portion and color developing ability are remarkably improved, and defects such as adhering of depositions and occurrence of sticking are prevented effectively, in comparison with the thermally sensitive recording medium containing ultraviolet ray absorbents or the ultraviolet ray screening agents which are proposed in the prior arts. The specified thermally sensitive recording medium used in this invention is the thermally sensitive recording medium that possesses a thermally sensitive recording layer containing basic leuco dye and organic color developer on a substrate, further, possesses an under coating layer between said thermally sensitive recording layer and substrate, a protecting layer on the thermally sensitive recording layer and a middle layer between the thermally sensitive recording layer and the protecting layer when the need arises. And, when the thermally sensitive recording medium has a protecting layer and above mentioned aqueous emulsion type polymer ultraviolet ray absorbent is contained in said protecting layer, a barrier ability is remarkably improved besides above mentioned properties, in comparison with the thermally sensitive recording media that contain conventional ultraviolet ray absorbents.

That is, the ultraviolet ray absorbing ability of the aqueous emulsion type polymer ultraviolet ray absorbent of this invention is excellent because of large amount of ultraviolet ray absorbing monomer contained in a molecular and the aqueous emulsion type polymer ultraviolet ray absorbent of this invention indicates good light resistance by small amount. Therefore, the defects such as deterioration of color developing density or background fogging caused by large amount use of an ultraviolet ray absorbent can be prevented. Still more, by the use of reactive emulsifier, the effect to the color developing materials becomes very small, and good color developing ability and excellent appearance of unreacted portion can be obtained. Furthermore, by the use of hydrophilic monomer, since the solubility with aqueous binder is good and solubility with plasticizer, oil or organic solvent is poor, when it is contained in a protecting layer, the deterioration of a barrier function does not occur and resistance to chemicals is excellent. Still further, if the glass transition temperature (Tg) is high, heat resistance is improved and even if it is contained in a protecting layer, defects, which are observed at the recording process, such as adhering of depositions and occurrence of sticking caused on a thermal head, do not occur. That is, also the recording runnability improved.

Yet further, in general, in a case that an ultraviolet ray absorbent is used in a thermally sensitive recording medium, when an ultraviolet ray absorbent of larger average particle size is used, a problem of recorded image fogging (the state that the recorded image becomes whity, cloudy or hazy) becomes easy to occur, and therefore, it is said that the smaller particle size is better. However, in a case of an ultraviolet ray absorbent of aqueous emulsion type polymer of this invention, even if the ultraviolet ray absorbent of relatively large particle size is used, the clear recorded image in which the problem of recorded image fogging is dissolved, can be obtained. Although the reason why is not made clear yet, however, since the aqueous emulsion type polymer ultraviolet absorbent of this invention contains hydrophilic monomer as one of the important factor, it is guessed that said aqueous emulsion type polymer ultraviolet absorbent has good compatibility with aqueous binder and indicates good transparency when film is formed.

In the present invention, by containing above mentioned special aqueous emulsion type polymer ultraviolet ray absorbent in a thermally sensitive recording layer, or, in an under coating layer, a middle layer or a protecting layer, which are prepared at need, the desired effect can be obtained. Said special aqueous emulsion type polymer ultraviolet ray absorbent can be contained in one layer or more than two layers, and the combination of layers is not restricted. Further, the number of layers of thermally sensitive layer, undercoating layer, middle layer and protecting layer is not respectively restricted to only one layer. Each layer can be multiply prepared.

The adding amount and the position (layer) of ultraviolet ray absorbent to the thermally sensitive medium depend on the required qualities of the thermally sensitive medium, however, from the view point of absorbing efficiency of ultraviolet rays, it is preferable to blend the ultraviolet ray absorbent in outer layer, namely, the thermally sensitive layer is better than the under coating layer and the protecting layer is better than the thermally sensitive layer.

The containing amount of the ultraviolet ray absorbent of this invention to the under coating layer is desirably 0.1–80 wt % to the dry weight of the under coating layer, and more desirably is 1–50 wt %. If the containing amount is under 0.1 wt %, a sufficient light resistance can not be obtained. And if the containing amount is over 80 wt %, the adhering strength between substrate and under coating layer is deteriorated, and consequently the surface strength as the thermally sensitive recording medium is weakened. Therefore, in this case, it is not suited to the use which requires cellopick strength and printability.

In regard to the thermally sensitive recording layer, the containing amount of the ultraviolet ray absorbent of this invention is desirably 0.1–25 wt % to the dry weight of the thermally sensitive recording layer, and more desirably 1–20 wt %. If the containing amount is under 0.1 wt %, a sufficient light resistance can not be obtained. And if the containing amount is over 25 wt %, influence to the deterioration of color developing density and background fogging becomes serious.

The containing amount of the ultraviolet ray absorbent of this invention to the protective layer is desirably 0.1–30 wt % to the dry weight of the protective layer, and more desirably is 1–25 wt %. If the containing amount is under 0.1 wt %, a sufficient light resistance can not be obtained. And if the containing amount is over 30 wt %, the barrier ability becomes insufficient.

Further, in the present invention, for the purpose to improve light resistance more, it is possible to use conventional well-known other ultraviolet ray absorbent or ultraviolet ray screening agent together with the aqueous emulsion type polymer ultraviolet ray absorbent of this invention in the limit not to hurt the effect of this invention. As the conventional ultraviolet ray absorbent, 2,2'-methylenebis[4-(1,1,3,3-tetramethylbuthyl)-6-(2H-benzotriazole-2-yl) phenol, 2(2'-hydroxy-3'-t-buthyl-5'-methyl-phenyl)5-chloro-benzotriazole and 2,2'-p-phenylenebis(4H-3,1-benzoxazine-4-on) and others can be mentioned. And as the ultraviolet screening agents, a calcined particle having triple layer composed of flaky pigment whose refractive index is 1.5–1.6 coated by insoluble cerium compound and amorphous silica, inorganic powder obtained by drying, calcining the double layer structure composed of insoluble cerium compound coated with amorphous silica and others can be mentioned.

In the present invention, the kind of basic leuco dye to be used in the thermally sensitive recording layer is not restricted, however, a leuco dye such as triphenyl methane type, fluoran type, azaphtalide type or fluorene type can be desirably used. The concrete examples of these leuco dyes are mentioned below. These basic leuco dyes can be used alone or can be used together with.

<Triphenylmethane Type Leuco Dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran Type Leuco Dyes>

3-diethylamino-6-methylfluoran
3-diethylamino-6-methyl-7-anilinofluoran
3-diethylamino-6-methyl-7-(o,p-dimethylanilino)fluoran
3-diethylamino-6-methyl-7-chlorofluoran
3-diethylamino-6-methyl-7-(m-trifluoromethylanilino) fluoran
3-diethylamino-6-methyl-7-(o-chloroanilino)fluoran
3-diethylamino-6-methyl-7-(p-chloroanilino)fluoran
3-diethylamino-6-methyl-7-(o-fluoroanilino)fluoran
3-diethylamino-6-methyl-7-(m-methylanilino)fluoran
3-diethylamino-6-methyl-7-n-octylanilinofluoran
3-diethylamino-6-methyl-7-n-octylaminofluoran
3-diethylamino-6-methyl-7-benzylanilinofluoran
3-diethylamino-6-methyl-7-dibenzylanilinofluoran
3-diethylamino-6-chloro-7-methylfluoran
3-diethylamino-6-chloro-7-anilinofluoran
3-diethylamino-6-chloro-7-p-methylanilinofluoran
3-diethylamino-6-ethoxyethyl-7-anilinofluoran
3-diethylamino-7-emoethylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylamino-6-methyl-7-(o,p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino) fluoran
3-dibutylamino-6-methyl-chlorofluoran
3-dibutylamino-6-ethoxyethyl-7-anilinofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroanilino)fluoran
3-di-n-pentylamino-7-(m-trifluoromethylaniliono)fluoran
3-di-n-pentylamino-6-chloro-7-anilinofluoran
3-di-n-pentylamino-7-(p-chloroanilino)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino) fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino) -6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl) aminoanilinofluoran
2-methoxy-6-p-(p-dimethylaminophenyl) aminoanilinofluoran
2-chloro-3-methyl-6-p-(p-phenylaminophenyl) aminoanilinofluoran
2-chloro-6-p-(p-dimethylaminophenyl) aminoanilinofluoran
2-nitro-6-p-(p-diethylaminophenyl)aminoanilinofluoran
2-amino-6-p-(p-diethylaminophenyl)aminoanilinofluoran 2-diethylamino-6-p-(p-diethylaminophenyl) aminoanilinofluoran 2-phenyl-6-metyl-6-p-(p-phenylaminophenyl) aminoanilinofluoran 2-benzyl-6-p-(p-phenylaminophenyl) aminoanilinofluoran 2-hydroxy-6-p-(p-phenylaminophenyl) aminoanilinofluoran 3-methyl-6-p-(p-dimethylaminophenyl) aminoanilinofluoran 3-diethylamino-6-p-(p-diethylaminophenyl) aminoanilinofluoran 3-diethylamino-6-p-(p-dibutylaminophenyl) aminoanilinofluoran 2,4-dimethyl-6-[(4-dimethylamino)anilino]-fluoran <Fluorene Type Leuco Dyes>

3,6,6'-tris(dimethylamino)spiro[fluorene-9,3'-phthalide]

3,6,6'-tris(diethylamino)spiro[fluorene-9,3'-phthalide]

<Divinyl Type Leuco Dyes>

3,3-bis-[2-(p-dimethylaminophenyl)-2-(p-methoxyphenyl)ethenyl]-4,5,6,7-tetra bromophthalide 3,3-bis-[2-(p-dimethylaminophenyl)-2-(p-methoxyphenyl)ethenyl]-4,5,6,7-tetra chlorophthalide 3,3-bis-[1,1-bis (4-pyrrolidinophenyl)ethylen-2-yl]-4,5,6,7-tetrabromophthalide 3,3-bis-[1-(4-methoxyphenyl)-1-(4-pyrrolidinophenyl) ethylene-2-yl]-4,5,6,7-tetrac hlorophthalide <Others>

3-(4-diethylamino-2-ethoxyphenyl)-3-(1-ethyl-2-methylindol-3-yl)-4-aza phthalide 3-(4-diethylamino-2-ethoxyphenyl)-3-(1-octyl-2-methylindol-3-yl)-4-aza phthalide 3-(4-cyclohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluoran-γ-(3'-nitro)anilinolactam 3,6-bis(diethylamino)fluoran-γ-(4'-nitro)anilinolactam 1,1-bis-[2',2',2",2"-tetrakis-(p-dimethylaminophenyl)-ethenyl]-2,2-dinitrilethane 1,1-bis-[2',2',2",2"-tetrakis-(p-dimethylaminophenyl)-ethenyl]-2-β-naphthoyl ethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonicacid dimethylester.

As an organic color developer used in a thermally sensitive recording layer of this invention, the well-known color developer can be mentioned as follows, however, not intended to be limited to them.

Inorganic acidic substance such as activated clay, colloidal silica or aluminium silicate, 4,4'-isopropylidenediphenol 1,1-bis(hydroxyphenyl)cyclohexane 2,2-bis(hydroxyphenyl)-4-methylpentane 4,4'-dihydroxydiphenyisulfido hydroquinonemonobenzylether 4-hydroxybenzoicbenzyl 4,4'-dihydroxydiphenylsulfone 2,4'-dihydroxydiphenylsulfone 4-hydroxy-4'-isopropoxydiphenylsulfone 4-hydroxy-4-n-propoxydiphenylsulfone bis(3-allyl-4-hydroxyphenyl)sulfone 4-hydroxy-4'-methyldiphenylsulfone 4-hydroxyphenyl-4'-benzyloxyphenylsulfone 3,4-dihydroxyphenyl-4'-methylphenylsulfone Derivative of aminobenzenesulfone amide described in Japanese Patent Laid Open Publication 8-59603, bis(4-hydroxyphenylthioethoxy)methane 1,5-di(4-hydroxyphenylthio)-3-oxapentane bis(p-hydroxyphenyl)butyl acetate bis(p-hydroxyphenyl)methyl acetate 1,1-bis(4-hydroxyphenyl)-1-phenylethane 1,4-bis[α-methyl-α-(4'-hydroxyphenyl)ethyl]benzene 1,3-bis[α-methyl-α-(4'-hydroxyphenyl)ethyl]benzene di (4-hydroxy-3-methylphenyl)sulfido 2,2'-thio-bis(3-tert-octylphenol)

2,2'-thio-bis(4-tert-octylphenol)

Phenolic compound such as diphenylsulfone bridged type compound described in WO97/16420, thio urea compound such as N,N'-di-m-chlorophenylthiourea, p-chloro benzoic acid, gallic acid stearyl aromatic carboxylic acid such as bis[4-(n-octyloxycarbonylamino)zinc salicylate]2 hydrate, 4-[2-(p-methoxyphenoxy)ethyloxy]salicylic acid, 4-[3-(p-tolylsulfonyl)propyloxy]salicylic acid or 5-[p-(2-p-methoxyphenoxy)cumyl]salicylic acid and metallic salt of these aromatic carboxylic acid with zinc, magnesium, aluminium, calcium, titanium, manganese, tin or nickel, further, antipyrine complex of zinc thiocyanate and complex zinc salt of terephtalic aldehyde acid and other aromatic carboxylic acid can be mentioned. These organic color developers can be used alone or can be used together with.

Further, a metal chelate type color developing component such as high fatty acid metal complex salt described in Japanese Patent Laid Open Publication 10-258577 or multivalent hydroxy aromatic compound can be used.

In the present invention, for the purpose to improve the thermally recording color developing sensitivity, a sensitizer can be contained in the thermally sensitive recording layer. As the sensitizers, any kinds of compounds that are conventionally used in a thermally sensitive recording medium. For example, stearic acid amide, fatty acid amide such as palmitic acid amide, ethylenebisamide, montanewax, polyethylenewax, dibenzyl terephthalate, p-benzyloxy benzyl benzoate, di-p-tolylcarbonate, p-benzylbiphenyl, phenyl α-naphthylcarbonate, 1,4-diethoxy naphthalene, 1-hydroxy-2-phenylnaphthoate, 1,2-di-(3-methylphenoxy)ethane, oxalic acid di(p-methylbenzyl), β-benzyloxy naphthalene, 4-biphenyl-p-tolylether, o-xylene-bis-(phenylether), 4-(m-methyl phenoxymethyl)biphenyl, p-toluenesulfoneamide and o-toluenesulfoneamide can be added. These sensitizers can be used alone or can be used together with.

In the present invention, mainly for the purpose to improve the preservative ability of the color developed recorded image, an image stabilizer can be contained in the thermally sensitive recording layer. As the image stabilizer, for example, at least one compound selected from the group composed of phenol type compound such as 1,1,3-tris(2-methyl-4-hydroxy-5-cyclohexylphenyl) butane, 1,1,3-tris(2-methyl-4-hydroxy-5-tert-butylphenyl)butane,
1,1-bis(2-methyl-4-hydroxy-5-tert-butylphenyl)butane,
4,4'-[1,4-phenylenebis(1-methylethylidene)]bisphenol,
4,4'-[1,3-phenylenebis(1-methylidene)]bisphenol,
4,4'-butylidene(6-t-butyl-3-methylphenol) or
2,2'-di-t-butyl-5,5'-dimethyl-4,4'-sulfonyldiphenol, epoxy compound such as
4-benzyloxyphenyl-4'-(2-metyl-2,3-epoxypropyloxy) phenylsulfone,
4-(2-metyl-1,2-epoxyethyl)diphenylsulfone or
4-(2-ethyl-1,2-epoxyethyl)diphenylsulfone and isocyanuric acid compound such as
1,3,5-tris(2,6-dimethylbenzyl-3-hydroxy-4-tert-butyl) isocyanuric acid can be used. These image stabilizers can be used alone or can be used together with.

As the binder to be used in the present invention, full saponificated polyvinyl alcohol of 200–1900 polymerization degree, partial saponificated polyvinyl alcohol, denatured polyvinyl alcohol by carboxyl, denatured polyvinyl alcohol by amide, denatured polyvinyl alcohol by sulfonic acid denatured polyvinyl alcohol by butyral or other modified polyvinyl alcohol, derivatives of cellulose such as hydroxyethyl cellulose, methyl cellulose, ethyl cellulose, carboxymethyl cellulose and acetyl cellulose, copolymer of styrene-maleic acid anhydride, copolymer of styrene-butadiene, polyvinyl chloride, polyvinyl acetate, polyacrylamide, polyacrylic acid ester, polyvinylbutyral, polystyrene or copolymer of them, polyamide resin, silicone resin, petroleum resin, terpene resin, ketone resin and coumarone resin can be illustrated. These macromolecule compounds can be applied by being dissolved into solvents such as water, alcohol, ketone, ester or hydrocarbon or by being dispersed in water or other medium under an emulsion state or a paste state, and these forms of application can be used in combination according to the quality requirement.

As a filler which can be used in this invention, an inorganic filler such as silica, calcium carbonate, clay, kaoline, calcined kaoline, diatomaceous earth, synthetic aluminum silicate, talc, zinc oxide, titanium dioxide, aluminum hydroxide, zinc hydroxide, barium sulfate, magnesium carbonate, surface treated calcium carbonate or silica, and an organic filler such as urea-formalin resin, styrene-methacrylic acid copolymer resin, polystyrene resin and vinylidene chloride can be mentioned.

Further, a parting agent such as metallic salts of fatty acid, a lubricant such as waxes, a water resistance agent such as glyoxal, a dispersing agent, a defoamer, and fluorescent dye, which are well-known materials used in a thermally sensitive recording medium can be preferably used.

The preparing method of the coating for a thermally sensitive recording layer of this invention is not restricted, however, the amount of basic leuco dye, organic color developer and kind and amount of other component is decided according to the required properties and recording aptitude. The desirable amount of organic color developer is 1–8 parts, desirable amount of filler is 1–20 parts to 1 part of basic leuco dye and desirable amount of binder is 5–25% to the total weight of solid. Said basic leuco dye, organic color developer and other additives which are added at need are ground to the fine particles smaller than several microns diameter by means of a grinder such as a ball mill, an attriter or a sand grinder, or by means of an adequate emulsifying apparatus, then binder and additives such as aqueous emulsion type polymer ultraviolet ray absorbent of this invention are added and the coating is prepared.

The method to form the thermally sensitive recording layer is not restricted, and the coating of above mentioned recipe is coated over the substrate by means of blade coater, air knife coater, bar coater or reverse roll coater and dried up, thus the aimed thermally sensitive recording medium can be obtained.

In the thermally sensitive recording medium, an undercoating layer can be prepared between thermally sensitive recording layer and substrate. In this case, usually the undercoating layer contains a binder and a filler. As the binder, filler and other additives, materials that are disclosed as the components of thermally sensitive recording layer can be preferably used according to the required qualities. Calcined kaolin, well-known hollow particles used for undercoating layer of conventional thermally sensitive recording medium such as fine hollow particles with hull described in Japanese Patent Publication 3-54074 or cup shape hollow polymer particles described in Japanese Patent Laid Open Publication 10-258577 has an excellent adiabatic effect and desirable for the filler used for undercoating layer. In the present invention, above mentioned aqueous emulsion type polymer ultraviolet ray absorbent can be preferably blended to the undercoating layer when the need arises.

The preparing method of a coating for the undercoating layer is not restricted. In general, a binder and a filler are poured into water, which is a dispersing medium, then above mentioned aqueous emulsion type polymer ultraviolet ray absorbent and a defoamer are added at need and mixed. Thus the coating for the undercoating layer is prepared. The method to form an undercoating layer is not restricted, and for example, a coating for the undercoating layer is coated on the substrate by various coating methods same as to the forming method of above mentioned thermally sensitive recording layer, and dried up and the undercoating layer is formed.

In the thermally sensitive recording medium, in a case to provide a protecting layer on thermally sensitive recording layer, usually, such kind of protecting layer contains a binder and a filler. As the binder, filler and other additives, materials that are disclosed as the components of thermally sensitive recording layer can be preferably used according to the required qualities. In this case, it is desirable to add a bridging agent so as to provide water resistance to the protecting layer. In the present invention, above mentioned aqueous emulsion type polymer ultraviolet ray absorbent can be preferably blended to the protecting layer at need.

The preparing method of a coating for the protecting layer is not restricted. In general, a binder and a filler are poured into water, which is a dispersing medium, then above mentioned aqueous emulsion type polymer ultraviolet ray absorbent, a filler and a lubricant are added at need and mixed. Thus the coating for the protecting layer is prepared. The method to form a protecting layer is not restricted, and for example, a coating for the protecting layer is coated on the thermally sensitive recording layer by various coating methods same as to the forming method of above mentioned thermally sensitive recording layer, and dried up and the protecting layer is formed.

In the thermally sensitive recording medium, a middle layer can be prepared between thermally sensitive recording layer and a protecting layer. In this case, usually the middle layer contains a binder and a filler. As the binder, filler and other additives, materials that are disclosed as the components of thermally sensitive recording layer can be preferably used according to the required qualifies. In this case, it is desirable to add a bridging agent so as to provide water resistance to the middle layer. In the present invention, above mentioned aqueous emulsion type polymer ultraviolet ray absorbent can be preferably blended to the middle layer at need.

The preparing method of a coating for the middle layer is not restricted. In general, a binder and a filler are poured into water, which is a dispersing medium, then above mentioned aqueous emulsion type polymer ultraviolet ray absorbent, a filler and a lubricant are added at need and mixed. Thus the coating for the middle layer is prepared. The method to form a middle layer is not restricted, and for example, a coating for the middle layer is coated on the thermally sensitive recording layer by various coating methods same as to the forming method of above mentioned thermally sensitive recording layer, and dried up and the middle layer is formed.

As a substrate to be used in a thermally sensitive recording medium of this invention, any kinds of materials that can maintain the thermally sensitive recording layer and other layers provided in case of need, such as paper (acidic paper, neutralized paper), recycled paper, plastic film, synthetic paper, nonwoven fabrics or metal vaporized sheet can be used.

EXAMPLE

The thermally sensitive recording medium of this invention will be illustrated more concretely by Examples, however, not intended to be limited to them. In the Examples and Comparative Examples, a term of "parts" indicates weight part.

Example 1–8

Examples 1–8 are the examples that the aqueous emulsion type polymer ultraviolet ray absorbent of this invention is used in a protecting layer. As an ultraviolet ray absorbent, compounds shown in Preparation Examples 1–8 are used independently.

(1) Forming of thermally sensitive recording layer

Each solution of following recipe is separately ground in wet condition to average particle diameter of 1 $\mu$m by a sand grinder.

A solution (dispersion of color developer)

| | |
|---|---|
| 2,4'-dihydroxydiphenylsulfone | 6.0 parts |
| 10% polyvinyl alcohol aqueous solution | 18.8 parts |
| water | 11.2 parts |

B solution (dispersion of basic leuco dye)

| | |
|---|---|
| 3-di-butylamino-6-methyl-7-anilinofluoran (ODB-2) | 2.0 parts |
| 10% polyvinyl alcohol aqueous solution | 4.6 parts |
| water | 2.6 parts |

C solution (dispersion of sensitizer)

| | |
|---|---|
| Para-benzylbiphenyl | 4.0 parts |
| 10% polyvinyl alcohol aqueous solution | 5.0 parts |
| water | 3.0 parts |

Then obtained dispersions are mixed by following ratio and stirred, and the coating for thermally sensitive recording layer is obtained.

| | |
|---|---|
| A solution | 36.0 parts |
| B solution | 9.2 parts |
| C solution | 12.0 parts |
| Kaolin clay (50% dispersion) | 12.0 parts |

The obtained coating is coated on a surface of 50 g/m$^2$ woodfree paper composed of 80% LBKP and 20% NBKP so as the coating amount to be 6.0 g/m$^2$ and dried, and a thermally sensitive recording layer is obtained.

(2) Forming of a protecting layer

The materials mentioned below are mixed and the coatings for protecting layer are prepared.

| | |
|---|---|
| 10% polyvinyl alcohol aqueous solution | 60.0 parts |
| aluminum hydroxide (50% dispersion) | 30.0 parts |
| zinc stearate | 10.0 parts |
| water | 50.0 parts |
| compounds of Preparation Examples 1~8 (30%) | 20.0 parts |

The obtained coatings are coated on a thermally sensitive recording layer so as the coating amount to be 4.0 g/m$^2$ and dried, and the protecting layers are obtained.

The sheets are processed by a super calendar so as the Bekk smoothness to be 200–600 seconds, and the thermally sensitive recording media are obtained.

Example 9

In Example 9, the ultraviolet ray absorbent of this invention is used in a thermally sensitive recording layer. At the formation of thermally sensitive recording layer of Example 1, 10.0 parts of ultraviolet ray absorbent of Preparation Example 8 (30%) is added to the coating for thermally sensitive recording layer, and by same process as Example 1 except not preparing a protecting layer, a thermally sensitive recording medium is obtained.

Example 10

In Example 10, the ultraviolet ray absorbent of this invention is used in a thermally sensitive recording layer and a protecting layer. At the formation of thermally sensitive layer of Example 8, by same process as Example 8 except adding 10.0 parts of ultraviolet ray absorbent of Preparation Example 2 (30%) to the coating for thermally sensitive recording layer, a thermally sensitive recording medium is obtained.

Example 11

In Example 11, the ultraviolet ray absorbent of this invention is used in an undercoating layer and a protecting layer. By same process as Example 8 except forming an undercoating layer as mentioned below, a thermally sensitive recording medium is obtained. Said undercoating layer is formed between substrate and thermally sensitive recording layer and contains the ultraviolet ray absorbent of Preparing Example 4.

Forming of undercoating layer

| | |
|---|---|
| 10% polyvinyl alcohol aqueous solution | 150 parts |
| calcined kaolin (40% dispersion) | 250 parts |
| compound of Preparation Example 4 (30%) | 50 parts |

Above mentioned materials are mixed by above mentioned ratio and stirred, and the coating for undercoating layer is obtained. The obtained coating is coated on a surface of 50 g/m$^2$ woodfree paper composed of 80% LBKP and 20% NBKP so as the coating amount to be 5.0 g/m$^2$ and dried, and an undercoating layer is formed.

Example 12

In Example 12, the ultraviolet ray absorbent of this invention is used in an undercoating layer, a thermally sensitive recording layer and a protecting layer. By same process as Example 11, except adding the ultraviolet ray absorbent of the Preparation Example 2 (30%) to the coating for thermally sensitive recording layer, a thermally sensitive recording medium is obtained.

Example 13

At the formation of an undercoating layer of Example 11, D solution is added to a coating for undercoating layer instead of 50 parts of ultraviolet ray absorbent of Preparation Example 4 (30%), and at the formation of a thermally sensitive recording layer, by same process as Example 11, except adding E solution to the coating for thermally sensitive recording layer, a thermally sensitive recording medium is obtained.

D solution (dispersion of ultraviolet absorbent 1)

| | |
|---|---|
| 2(2'-hydroxy-3'-t-butyl-5'-methyl-phenyl)5-chloro-benzotriazole | 15.0 parts |
| 10% polyvinylalcohol aqueous solution | 30.0 parts |
| water | 30.0 parts |

The solution of above mentioned recipe is ground in wet condition to average particle diameter of 1 μm by a sand grinder.

E solution (dispersion of ultraviolet absorbent 2)

| | |
|---|---|
| 2,2'-methylenebis[4-(1,1,3,3,-tetramethylbutyl)-6-(2H-benzotriazole-2-yl)phenol] | 3.0 parts |
| 10% polyvinylalcohol aqueous solution | 6.0 parts |
| water | 6.0 parts |

The solution of above mentioned recipe is ground in wet condition to average particle diameter of 1 μm by a sand grinder.

Example 14

At the formation of a thermally sensitive recording layer of Example 8, by same process as Example 8, except adding F solution to the coating for thermally sensitive recording layer, a thermally sensitive recording medium is obtained.

F solution (dispersion of ultraviolet ray absorbent 3)

| | |
|---|---|
| 2,2'-p-phenylenebis(4H-3,1-benzoxazine-4-on) | 3.0 parts |
| 10% polyvinylalcohol aqueous solution | 6.0 parts |
| water | 6.0 parts |

The solution of above mentioned recipe is ground in wet condition to average particle diameter of 1 μm by a sand grinder.

Example 15

At the formation of an undercoating layer of Example 11, by same process as Example 8, except adding G solution instead of 50 parts of compound of Preparation Example 4, a thermally sensitive recording medium is prepared.

G solution(dispersion of ultraviolet ray screening agent)

| | |
|---|---|
| Ultraviolet ray screening agent of Producing Example mentioned below | 15.0 parts |
| 10% polyvinylalcohol aqueous solution | 30.0 parts |
| water | 30.0 parts |

The solution of above mentioned recipe is ground in wet condition to average particle diameter of 1 μm by a sand grinder.

<Producing Example>

500 g of flaky silica, which is a material for nucleus of an ultraviolet ray screening agent is poured into 10 liter of water, then dispersed for one hour by means of DISPAMILL (product of Hosokawa Micron). The obtained dispersion is heated to 80° C., and 264 g of aqueous solution of cerium nitrate ($CeO_2$ content is 19 wt %, insoluble cerium compound sediment amount converted in $CeO_2$ is 10 wt %) is dropped in with constant stirring. Then, the dispersion is neutralized by sodium hydroxide solution to pH7–9, cerium hydroxide is accumulated on the surface of silica so as to form a coating layer. The obtained product is filtrated, rinsed by water and dried up, then ground, and flake type cerium coated silica pigment is obtained. The obtained flake type cerium coated silica pigment is put into 10 liter of water and dispersed for one hour by means of DISPAMILL. The obtained dispersion is heated to 80° C., and 348 g of No.3 sodium silicate ($SiO_2$ content is 28.5 wt %, amorphous silica sediment amount converted into $SiO_2$ is 18 wt %) is dropped in with constant stirring. Diluted sulfuric acid is added to maintain pH of solution in 9–11, continue the constant stirring for another one hour, then pH of solution is adjusted to 6–8 using sulfuric acid. The obtained product is filtrated, rinsed by water and dried up, then ground and flake type cerium-silica coated silica pigment is obtained. Further, this pigment is calcined at the temperature of 500° C. for two hours and the ultraviolet ray screening agent of triple layer structure ($CeO_2$ 10 wt %-$SiO_2$ 18 wt %) is obtained.

Example 16

Example 16 is the example which uses a recycled paper as a substrate. By same process as Example 8 except using a mechanical paper (50 g/m$^2$) composed of 85% of waste paper pulp and 15% of NBKP instead of a woodfree paper (50 g/m$^2$) composed of 80% of LBKP and 20% of NBKP, a thermally sensitive recording medium is prepared.

Comparative Example 1

Comparative Example 1 is the example in which no ultraviolet ray absorbent is used. At the formation of a protecting layer of Example 1, by same process as Example 1, except not adding an ultraviolet ray absorbent, a thermally sensitive recording medium is prepared.

Comparative Example 2

At the formation of a thermally sensitive recording layer of Example 9, by same process as Example 9, except using compound 1 (30%) shown in Table 2 instead of using compound of Preparation Example 8, a thermally sensitive recording medium is prepared. Still more, all compounds described in Table 2 are prepared in accordance with Preparation Example 1. The compound 1 is an ultraviolet ray absorbent that non-reactive emulsifier is used at the preparation.

Comparative Example 3–5

At the formation of a protecting layer of Example 1, by same process as Example 1 except using compounds 2, 3, 4 (30% each) shown in Table 2 instead of using compound of Preparation Example 1, thermally sensitive recording media are prepared. The compound 2 is an ultraviolet ray absorbent whose Tg is 0° C. Further, the compound 3 is an ultraviolet ray absorbent that the hydrophilic monomer is not used at the preparation, and the compound 4 is an ultraviolet ray absorbent that hydrophobic bridgeable monomer is used instead of hydrophilic monomer at the preparation.

TABLE 2

| compound | U.V. absorbing monomer | bridgeable monomer | copolymerization monomer | emulsifier | polymerization initiator | Tg (° C.) | particle size |
|---|---|---|---|---|---|---|---|
| 1 | 2-hydroxy-4-methacryloxy benzophenone (50) | 2-ethylhexyl methacrylate (3) | methyl methacrylate (47) | salt of alkylbenzene sulfuric acid (1) | 2,2'azobis[2-(2-imidazoline-2-yl) propane]hydro-chloride (0.5) | 85 | 300 nm |
| 2 | 2-[2'hydroxy-5'-(methacryloyloxy) phenyl]benzotriazole (20) | 2-hydroxyethyl acrylate (2) | butylacrylate (76) | Aqualon HS-10 (Daiichi Kogyo Seiyaku) (2) | 2,2'-azobis[2-(2-imidazoline-2-yl) propane]hydro-chloride (1) | 0 | 100 nm |
| 3 | 2-hydroxy-4-acryloyloxybenzo phenone (50) | | ethyl methacrylate (50) | Aqualon HS-20 (Daiichi Kogyo Seiyaku) (1) | 2,2'-azobis[N-(2-hydroxy ethyl)-2-methyl propionamidine]hydro-chloride (1) | 70 | 400 nm |
| 4 | 2-(2'hydroxy-5'-(methacryloyloxy ethylphenyl)-2H-benzotriazole (50) | glycidyl methacrylate (5) | butylacrylate (44) | Aqualon HS-20 (Daiichi Kogyo Seiyaku) (1) | 2,2'azobis[2-(2-imidazoline-2-yl) propane]hydro-chloride (0.5) | 40 | 250 nm |

Numerical number in parenthesis: used weight (g)

Evaluation of Color Developing

Thermal recording is carried out on the prepared thermally sensitive recording media using TH-PMD (printing tester for thermally sensitive recording paper, thermal head of Kyocera Co., Ltd. Is installed), which is a product of Ohkura Denki Co., by 0.42 mJ/dot impressed energy. Image density of recorded part is measured by means of a Macbeth densitometer (RD-914, amber filter used). (density: Da)

Evaluation of Light Resistance (1) The printed thermally sensitive recording medium is treated by Carbon ark Fade Meter (Toyo Seiki BH) for 12 hours, and the density of recorded part is measured by above mentioned method (density: Db). And the density of background is measured by changing the filter to a blue filter (density: Dc).

(2) Evaluation was carried out by following numerical formula.

Light resistance of recorded part (remaining ratio): $Db/Da \times 100 = Rd(\%)$ Light resistance of background part: Dc Bigger Rd value indicates better light resistance of recorded part. Actually it is desirable to be not less than 80%. And when Dc value is small, it indicates that the light resistance of background is good. Actually, it is desirable not to exceed 0.15.

Evaluation of Sticking

On the prepared thermally sensitive recording medium, image is printed by Panafax UF-22, which is a product of Panasonic, by transmitting mode, and the printing sound and the sticking of printed image are sensually evaluated.

Evaluation: ◎ quiet, ○ sounds slightly, actually no problem,

X noisy, stick pattern appears on image

It is desirable that the sound is low and the stick pattern is rare.

Evaluation of Printing Depositions

After 40 sheets of B4 size manuscript with vertical stripes pattern are copied using Panafax UF-22, which is a product of Panasonic, by copy mode, and the adherence of printing depositions to thermal head is evaluated by naked eyes of the inspector. It is desirable that the amount of adhered deposition is little.

Evaluation: ○ very little, Δ found out, X very much

Evaluation of Barrier Ability

This evaluation test is carried out only on the thermally sensitive recording medium that has a protecting layer. On the surface of protecting layer of obtained thermally sensitive recording medium, a drop of ethylacetate is dropped using a syringe and enlarged to a circle of 3 cm diameter by cotton cloth. After one minute, degree of color developing of thermally sensitive recording layer is evaluated by naked eyes of the inspector. It is desirable that the degree of color developing is low.

Evaluation: ◎ not developed, ○ almost not developed,

X area of color developed part is bigger than that of color undeveloped part

Results obtained by above mentioned evaluation tests are summarized in table 3. "-" mark that appears in table 3 indicates that the evaluation test is not carried out.

TABLE 3

| Example / Comp. Example | color developing ability Da | light resistance Rd (%) | Dc | sticking | deposition at printing | barrier ability |
|---|---|---|---|---|---|---|
| | Test results of qualities | | | | | |
| 1 | 1.18 | 85.1 | 0.10 | ◎ | ○ | ◎ |
| 2 | 1.20 | 83.9 | 0.11 | ◎ | ○ | ◎ |
| 3 | 1.19 | 86.7 | 0.12 | ◎ | ○ | ◎ |
| 4 | 1.19 | 85.0 | 0.12 | ◎ | ○ | ◎ |
| 5 | 1.19 | 83.8 | 0.10 | ○ | ○ | ◎ |
| 6 | 1.21 | 84.9 | 0.11 | ◎ | ○ | ◎ |
| 7 | 1.20 | 86.3 | 0.10 | ○ | ○ | ◎ |
| 8 | 1.21 | 87.0 | 0.10 | ◎ | ○ | ◎ |
| 9 | 1.24 | 80.6 | 0.14 | ◎ | ○ | — |
| 10 | 1.17 | 88.5 | 0.09 | ◎ | ○ | ◎ |
| 11 | 1.26 | 88.2 | 0.09 | ◎ | ○ | ◎ |
| 12 | 1.23 | 91.6 | 0.08 | ◎ | ○ | ◎ |
| 13 | 1.25 | 95.3 | 0.08 | ◎ | ○ | ◎ |
| 14 | 1.18 | 91.4 | 0.11 | ◎ | ○ | ◎ |
| 15 | 1.24 | 92.0 | 0.10 | ◎ | ○ | ◎ |
| 16 | 1.19 | 80.5 | 0.14 | ◎ | ○ | ◎ |
| Co. Ex. 1 | 1.19 | 30.0 | 0.32 | ◎ | ○ | ◎ |
| Co. Ex. 2 | 0.89 | 85.1 | 0.14 | ◎ | ○ | — |
| Co. Ex. 3 | 1.20 | 80.1 | 0.13 | X | X | ◎ |
| Co. Ex. 4 | 1.19 | 82.7 | 0.10 | ○ | ○ | X |
| Co. Ex. 5 | 1.17 | 81.5 | 0.11 | ○ | ○ | X |

As clearly understood from above mentioned Table 3, when an aqueous emulsion type polymer ultraviolet ray absorbent of this invention is used to a thermally sensitive recording medium, good light resistance can be obtained, and also color developing ability, occurrence of sticking and generation of printing depositions adherence are remarkably improved. Especially, in regard to sticking, when Tg of the ultraviolet ray absorbent used in the outermost layer of printing side of thermally sensitive recording medium is high, evaluation of sticking becomes better. Examples 1, 2, 3 and 8–16 in which an ultraviolet ray absorbent having Tg of not less than 80° C. is used are superior to Examples 5 and 7 in which an ultraviolet ray absorbent having Tg of 50–70° C. from the view point of sticking sound. Sticking condition of Examples 4 and 6 using an ultraviolet ray absorbent having Tg of 70–80° C. is middle level between said two groups. When a thermally sensitive recording medium has a protecting layer and an ultraviolet ray absorbent of this invention is used, the thermally sensitive recording medium displays excellent barrier ability. Meanwhile, in a case that an ultraviolet ray absorbent is not blended, as obvious from Comparative Example 1, the light resistance becomes very poor. Further, concerning the case of Comparative Examples in which other ultraviolet ray absorbents are used, that is, in a case of Comparative Example 2 in which non-reactive emulsifier is used, the color developing ability is inferior and in a case of Comparative Example 4 and 5 in which hydrophilic monomer is not contained, the barrier ability is inferior. Furthermore, in Comparative Example 3 whose Tg is low, generations of sticking and printing deposition can be observed. As mentioned above, by using the ultraviolet ray absorbent of aqueous emulsion type polymer of this invention, it is obvious that the thermally sensitive recording medium having good light resistance, good color developing ability and less generations of sticking and printing depositions can be obtained.

By this invention, the thermally sensitive recording medium having good light resistance, appearance of unrecorded portion and color developing ability, and less generations of sticking and printing depositions can be provided.

What is claimed is:

1. A thermally sensitive recording medium that possesses a thermally sensitive color developing layer containing colorless or pale colored basic leuco dye and an organic color developer as main components on a substrate, wherein said thermally sensitive recording medium contains at least one kind of an ultraviolet ray absorbent of aqueous emulsion type polymer composed of an emulsion copolymerized compound of (a) ultraviolet ray absorbing monomer, (b) vinyl compound monomer that can copolymerize with said monomer, (c) hydrophilic monomer and (d) reactive emulsifier.

2. The thermally sensitive recording medium of claim 1, wherein the glass transition temperature Tg of said emulsion copolymer is not less than 50° C.

3. The thermally sensitive recording medium of claim 2, wherein the ultraviolet ray absorbing monomer composing said aqueous emulsion type polymer ultraviolet ray absorbent is a compound represented by general formula I and/or general formula II, (I)

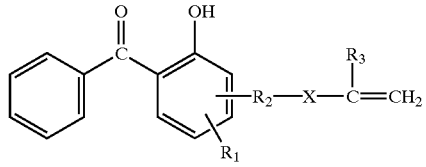

wherein, $R_1$ represents hydrogen atom, alkyl group or alkoxy group of carbon number 1–6, $R_2$ represents alkylene group or oxyalkylene group of carbone number 1–10, or not exists, in which case, X combines with benzene ring directly, X represents ester bond, amide bond, ether bond or urethane bond and $R_3$ represents hydrogen atom or lower alkyl group, (II)

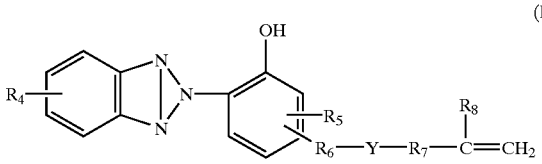

wherein, $R_4$ represents hydrogen, halogen or methyl group, $R_5$ represents hydrogen or hydrocarbon group of carbon number 1–6, $R_6$ represents alkylene group of carbon number 1–10 or oxyalkylene group or not exists, in which case, Y combines with benzene ring directly, Y represents ester bond, amide bond, ether bond or urethane bond, $R_7$ represents alkyiene group of carbon number 1–8, aminoalkylene group, alkyl group possessing hydroxide group at side chain or not exists in which case, Y combines with C directly and $R_8$ represents hydrogen or lower alkyl group.

4. The thermally sensitive recording medium of claim 3, wherein the reactive emulsifier is a polymerizable vinyl compound.

5. The thermally sensitive recording medium of claim 2, wherein the reactive emulsifier is a polymerizable vinyl compound.

6. The thermally sensitive recording medium of claim 1 or 2, wherein the ultraviolet ray absorbing monomer composing said aqueous emulsion type polymer ultraviolet ray absorbent is a compound represented by general formula I and/or general formula II, (I)

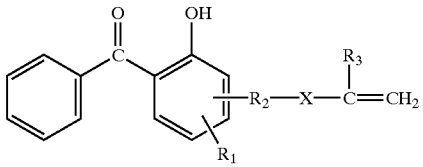

wherein, $R_1$ represents hydrogen atom, alkyl group or alkoxy group of carbon number 1–6, $R_2$ represents alkylene group or oxyalkylene group of carbone number 1–10, or not exists, in which case, X combines with benzene ring directly, X represents ester bond, amide bond, ether bond or urethane bond and $R_3$ represents hydrogen atom or lower alkyl group, (II)

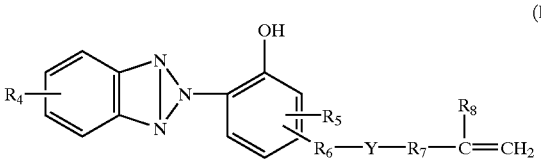

wherein, $R_4$ represents hydrogen, halogen or methyl group, $R_5$ represents hydrogen or hydrocarbon group of carbon number 1–6, $R_6$ represents alkylene group of carbon number 1–10 or oxyalkylene group or not exists, in which case, Y combines with benzene ring directly, Y represents ester bond, amide bond, ether bond or urethane bond, $R_7$ represents alkylene group of carbon number 1–8, aminoalkylene group, alkyl group possessing hydroxide group at side chain or not exists in which case, Y combines with C directly and $R_8$ represents hydrogen or lower alkyl group.

7. The thermally sensitive recording medium of claim 6, wherein the reactive emulsifier is a polymerizable vinyl compound.

8. The thermally sensitive recording medium of claim 1, wherein the reactive emulsifier is a polymerizative vinyl compound.

* * * * *